US007878796B1

(12) United States Patent
La Torre

(10) Patent No.: US 7,878,796 B1
(45) Date of Patent: Feb. 1, 2011

(54) COLORED FLAME CANDLE

(75) Inventor: Justin S. La Torre, White Plains, NY (US)

(73) Assignee: La Torre Innovations LLC, White Plains, NY (US)

( * ) Notice: Subject to any disclaimer, the term of this patent is extended or adjusted under 35 U.S.C. 154(b) by 0 days.

(21) Appl. No.: 11/938,265

(22) Filed: Nov. 10, 2007

(51) Int. Cl.
*F23Q 2/32* (2006.01)

(52) U.S. Cl. ..... 431/126; 431/4; 431/325; 44/275

(58) Field of Classification Search ..... 431/126, 431/325, 4; 44/275
See application file for complete search history.

(56) References Cited

U.S. PATENT DOCUMENTS

| | | | | | |
|---|---|---|---|---|---|
| 2,196,509 | A | * | 4/1940 | Cameron | 431/295 |
| 2,362,502 | A | * | 11/1944 | Schladt | 149/43 |
| 2,398,571 | A | * | 4/1946 | Young | 44/530 |
| 2,481,019 | A | * | 9/1949 | Joyce | 431/126 |
| 2,504,211 | A | * | 4/1950 | Means | 431/126 |
| 2,551,574 | A | * | 5/1951 | Fredericks | 44/275 |
| 3,150,510 | A | * | 9/1964 | Klopfenstein | 431/126 |
| 3,399,284 | A | * | 8/1968 | Ayers | 200/61.05 |
| 3,420,205 | A | * | 1/1969 | Ayers | 116/200 |
| 3,582,251 | A | * | 6/1971 | Concannon | 431/126 |
| 3,690,972 | A | * | 9/1972 | Kaye et al. | 149/18 |
| 3,811,817 | A | * | 5/1974 | Mansnerus et al. | 431/126 |
| 3,871,815 | A | | 3/1975 | Cangardel | |
| 3,888,177 | A | * | 6/1975 | Tyroler | 102/336 |
| 4,042,313 | A | | 8/1977 | Pierce | |
| 4,309,189 | A | | 1/1982 | Oberhardt | |
| 4,386,904 | A | | 6/1983 | Miyahara et al. | |
| 4,732,574 | A | * | 3/1988 | Forschirm | 44/628 |
| 4,997,457 | A | | 3/1991 | Mitsusawa et al. | |
| 5,127,922 | A | * | 7/1992 | Bension | 44/275 |
| 5,296,290 | A | * | 3/1994 | Brassington | 442/405 |
| 5,437,410 | A | * | 8/1995 | Babasade | 239/55 |
| D456,915 | S | | 5/2002 | Forkas | |
| 6,419,713 | B1 | * | 7/2002 | Durand et al. | 44/265 |
| 6,508,644 | B1 | * | 1/2003 | Pesu et al. | 431/35 |
| 6,712,865 | B2 | * | 3/2004 | Lu | 44/275 |
| 6,793,484 | B2 | * | 9/2004 | Pesu et al. | 431/35 |
| 6,921,260 | B2 | * | 7/2005 | Garnys | 431/126 |
| 2002/0139041 | A1 | * | 10/2002 | Calzada | 44/275 |
| 2002/0160327 | A1 | * | 10/2002 | Lim et al. | 431/126 |
| 2003/0036028 | A1 | * | 2/2003 | Pesu et al. | 431/35 |
| 2003/0064336 | A1 | * | 4/2003 | Welch et al. | 431/288 |
| 2003/0104330 | A1 | * | 6/2003 | Joyner | 431/288 |
| 2004/0033463 | A1 | * | 2/2004 | Pesu et al. | 431/289 |
| 2004/0033464 | A1 | * | 2/2004 | Pesu et al. | 431/289 |
| 2004/0137392 | A1 | * | 7/2004 | Garnys | 431/126 |
| 2006/0096157 | A1 | * | 5/2006 | Suzuki | 44/275 |

FOREIGN PATENT DOCUMENTS

| | | | | |
|---|---|---|---|---|
| DE | 29906914 | U1 | * | 10/1999 |
| HU | 209142 | B | * | 7/1995 |
| JP | 53030176 | A | * | 3/1978 |

* cited by examiner

*Primary Examiner*—Kenneth B Rinehart
*Assistant Examiner*—Jorge Pereiro
(74) *Attorney, Agent, or Firm*—Bryan Cave LLP

(57) ABSTRACT

A candle flame candle which is constructed of a center wick and a body of wax surrounding the center wick except a tip portion of wick wherein the wick is impregnated with at least one of a coloring agent and a color enhancer.

8 Claims, 1 Drawing Sheet

COLORED FLAME CANDLE

FIELD OF THE INVENTION

The present invention generally relates to an illumination apparatus and more particularly, relates to a candle that burns with colored flame.

BACKGROUND OF THE INVENTION

Candles have been one of the accessories used in most households. Candles are used not only for emergency illumination purpose, but even more popularly, used for mood enhancing or decoration. Candles which are fabricated with scented wax have also been popular in recent years to provide a pleasant scent in the environment that is burned. Most existing candles that can be purchased commercially gives out an amber colored flame when it is ignited. It would be desirable to provide a variation in the color of the flame in order to further enhance the mood or to further enhance a decorative effect.

It is therefore an object of the present invention to provide candles that does not have the drawbacks or shortcomings of the conventional candles.

It is another object of the present invention to provide a candle that can be burned with a colored flame.

It is a further object of the present invention to provide a colored flame candle by adding a coloring agent and a color enhancer in the candle wick.

SUMMARY OF THE INVENTION

In accordance with the present invention, a colored flame candle that can be burned exhibiting various different colors is provided.

In a preferred embodiment, the present invention colored flame candle is constructed of a center wick; and a body of wax surrounding the center wick except a tip portion of the wick; the wick is impregnated with at least one of a coloring agent and a color enhancer.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a colored flame candle that exhibits various colors in the flame when burned.

The present invention colored flame candle is a new type of candle that is novel, decorative, and esthetically pleasing. The candle adds an attractive touch to any décor. The colored flame candle features components similar to existing candles, however, the present invention colored flame candle features specialty chemicals used in the wick which produces flames in various colors. The different chemicals are a coloring agent and a color enhancer.

The types of coloring agents used in the wick of the present invention colored flame candle include barium salt, barium carbonate, barium nitrate, barium oxalate, copper and copper compounds, copper metal, cooper acetoarscenate, copper carbonate, copper chloride, copper oxides, copper oxychloride, lithium carbonate, sodium salts, strontium salts, strontium carbonate, strontium oxalate, and strontium nitrate. The various color enhancers that can be used in the wick of the present invention colored flame candle are calcium oxalate, hexachlorobenzene, parlon, polyvinylchloride, and saran.

The present invention novel colored flame candle provides entertaining and eye-catching design which further adds a decorative touch to any household environment. The improved candle can be produced in a wide range of sizes, colors, shapes, scents, and designs to coordinate with any décor. It can be offered with different flame and wax color combinations.

The present invention colored flame candle fulfills the need for a specially designed line of candles that would be novel and decorative in appearance. The appealing features of the present invention colored flame candle are its novelty, eye-catching design, attractiveness, decorative appeal, ease of use, and convenience. It provides enhanced visual appeal that can be more stimulating and interesting than a traditional candle. The novel color and design of the candle and flame would enhance the atmosphere of any room in a home or office.

Figure 1:
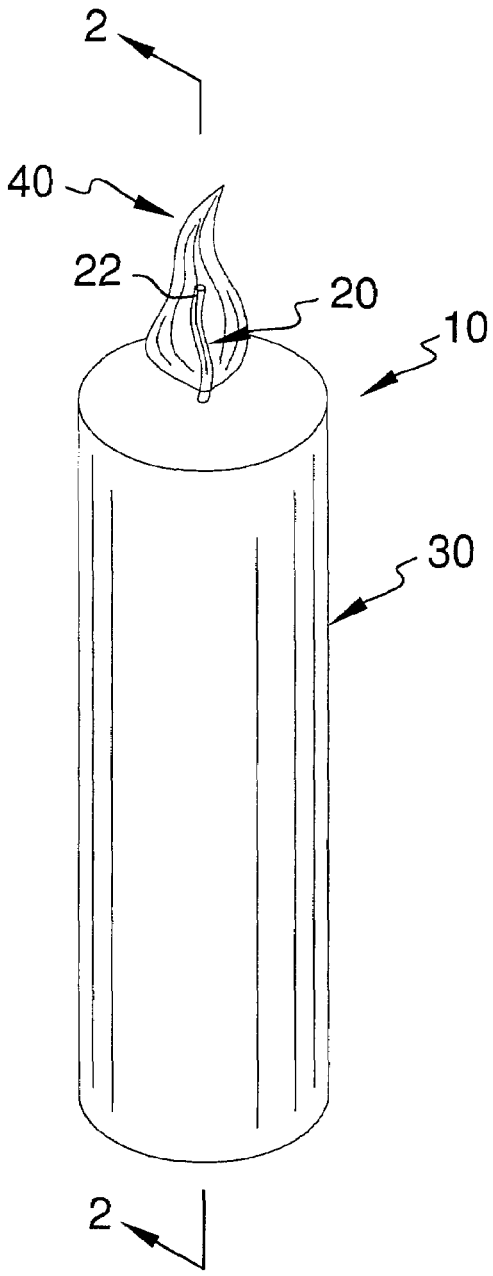
FIG. 1 is a perspective view of the present invention colored flame candle.

Referring initially to FIG. 1, wherein a perspective view of the present invention colored flame candle 10 is shown. The colored flame candle 10 is constructed of a center wick 20 and a body of wax 30. The body of wax 30 surrounds the center wick 20 except a tip portion 22 of the wick. The wick 20 is impregnated with at least one coloring agent and a color enhancer. The present invention colored flame candle 10 can further be made with scented wax in the body of wax 30 such that upon burning, the candle 30 gives up a pleasing fragrance.

The coloring agent for the present invention wick 20 can be at least one chemical selected from the group consisting of barium salt, barium carbonate, barium nitrate, barium oxalate, copper and copper compounds, copper metal, cooper acetoarscenate, copper carbonate, copper chloride, copper oxides, copper oxychloride, lithium carbonate, sodium salts, strontium salts, strontium carbonate, strontium oxalate, and strontium nitrate.

Similarly, the color enhancer used in the present invention wick 20 can be at least one chemical selected from the group consisting of calcium oxalate, hexachlorobenzene, parlon, polyvinylchloride, and saran.

It should be noted that while the presence of at least one coloring agent and at least one coloring enhancer is preferred, the mere present of a single coloring agent in the wick 20 may be sufficient to give out a colored flame 40, as shown in FIG. 1. The various coloring agents provides a vibrant color such as red, blue, green, yellow, purple, etc to the flame 40. Different colored flame can be suitably chosen to fit the mood in the environment when the candle is used. For instance, for a romantic atmosphere a red colored flame may be preferred in the present invention colored flame candle.

Figure 2:
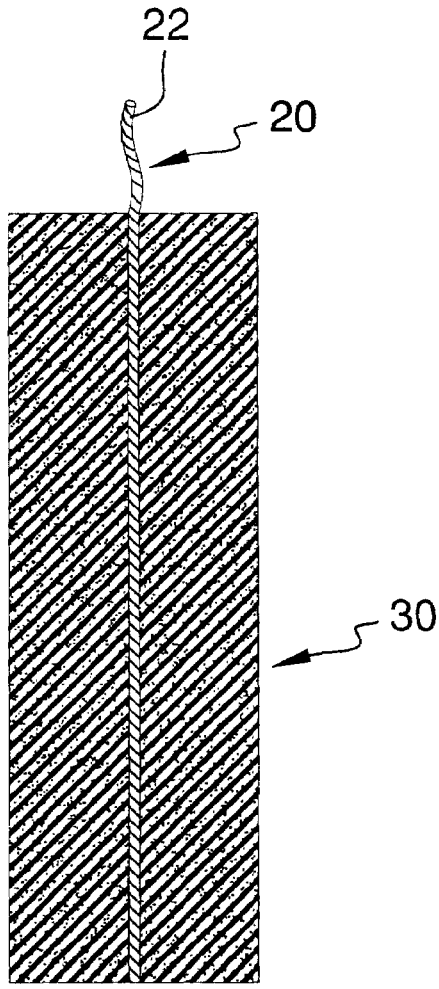
FIG. 2 is a cross-sectional view of the present invention colored flame candle.

The present invention colored flame candle has therefore been amply described in the above descriptions and in the appended drawings of FIGS. 1 and 2.

While the preferred embodiments of the invention have been described above, it will be recognized and understood that various modifications can be made in the invention and the appended claims are intended to cover all such modifications which may fall within the spirit and scope of the invention.

What is claimed is:

1. A colored flame candle comprising: a single wick disposed in the center of the candle; a body of wax surrounding said center wick except a tip portion of the wick; said wick is impregnated with a coloring agent and a color enhancer; wherein said coloring agent is selected from the group consisting of barium salt, barium carbonate, barium nitrate, barium oxalate, copper metal, copper oxides, sodium salts, strontium oxalate, and wherein said color enhancer is selected from the group consisting of calcium oxalate, and saran.

2. The colored flame candle according to claim 1, wherein said body of wax having an elongated, cylindrical shape.

3. The colored flame candle according to claim 1, wherein said body of wax further comprising at least one scent.

4. The colored flame candle according to claim 1, wherein said wick is impregnated with one coloring agent and one color enhancer.

5. A colored flame candle comprising: a single wick disposed in the center of the candle; a body of wax surrounding said center wick except a tip portion of the wick; said wick is impregnated with a coloring agent and a color enhancer; wherein said coloring agent is selected from the group consisting of barium carbonate, barium oxalate, copper metal, copper oxides, sodium salts, and wherein said color enhancer is saran.

6. The colored flame candle according to claim 5, wherein said body of wax has an elongated, cylindrical shape.

7. The colored flame candle according to claim 5, wherein said body of wax further comprises at least one scent.

8. The colored flame candle according to claim 5, wherein said wick is impregnated with one coloring agent and one color enhancer.

* * * * *